US005961009A

United States Patent [19]

Rekers

[11] Patent Number: 5,961,009

[45] Date of Patent: Oct. 5, 1999

[54] EXTENSIBLE CONNECTING PIECE

[75] Inventor: P. J. Rekers, Joure, Netherlands

[73] Assignee: Sara Lee/De N.V., Utrecht, Netherlands

[21] Appl. No.: 09/162,923

[22] Filed: Sep. 29, 1998

[30] Foreign Application Priority Data

Sep. 30, 1997 [NL] Netherlands ..... 1007170

[51] Int. Cl.[6] ..... B67D 5/06

[52] U.S. Cl. ..... 222/523; 222/530; 222/538

[58] Field of Search ..... 222/528, 530, 222/523, 538, 529

[56] References Cited

U.S. PATENT DOCUMENTS 2,300,414 11/1942 Grant ..... 222/523

FOREIGN PATENT DOCUMENTS 901615 7/1962 United Kingdom .

1277526 6/1972 United Kingdom ..... 222/538

*Primary Examiner*—Philippe Derakshani

*Attorney, Agent, or Firm*—Welsh & Katz, Ltd.

[57] ABSTRACT

A package for liquids, comprising a container and a tubular connecting piece connected to the container for dispensing liquid from the package in a dosed manner. The tubular connecting piece is composed of an outer tube and an inner tube which is concentrically included in the outer tube. For putting the package into use, the two tubes are located entirely within the contours of the package. For putting the package into use, the outer tube is pulled outwards and, accordingly, slides telescopically in the inner tube. The inner tube comprises a flexible portion, so that, while the flexible portion is folded inside out, it can likewise be pulled outwards.

16 Claims, 6 Drawing Sheets

EXTENSIBLE CONNECTING PIECE

Figure 1:
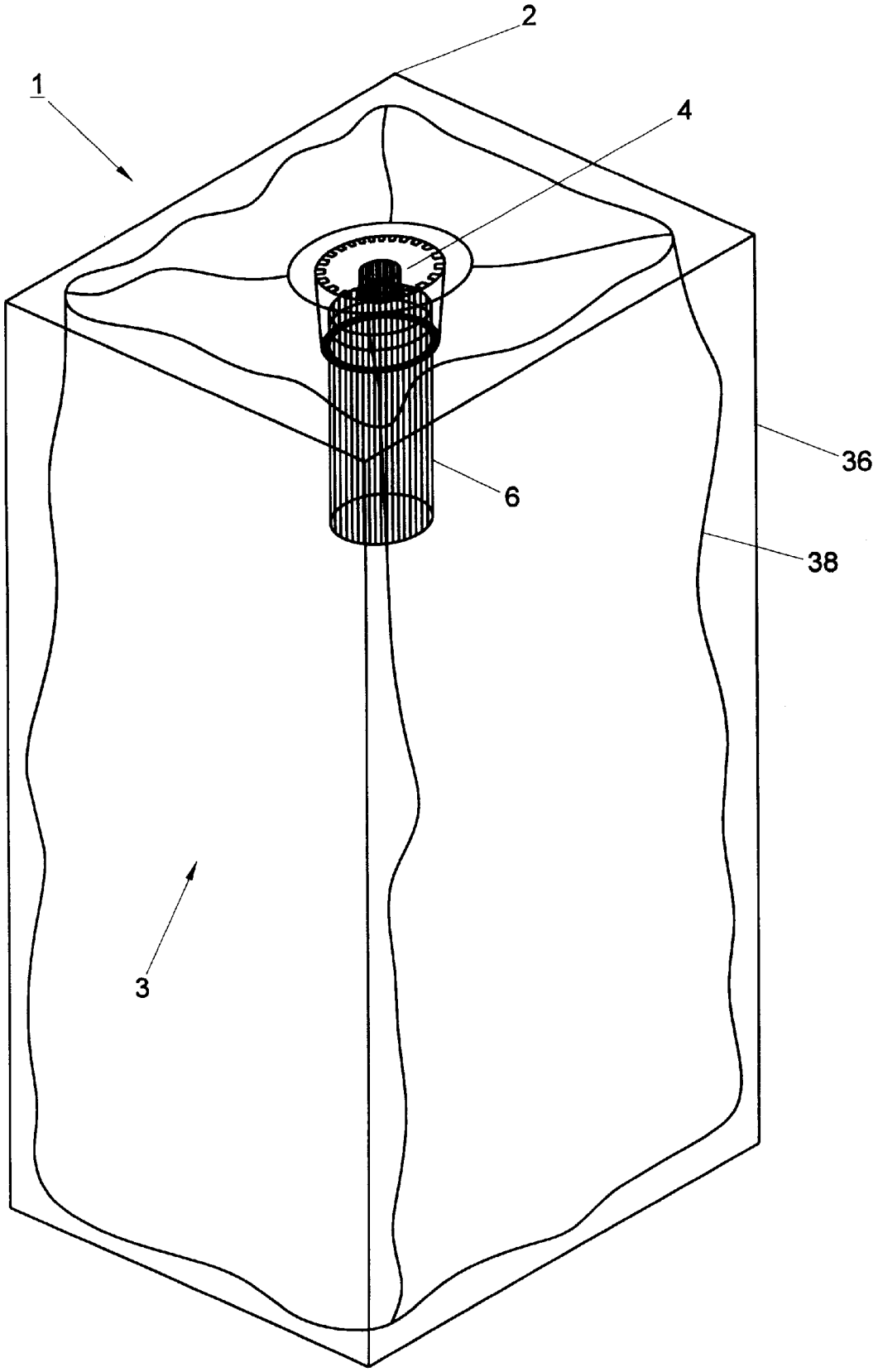

The invention relates to a package for liquids comprising a container having an opening and a tubular connecting piece connected to the container and arranged for dispensing, via the opening, liquid from an inner space of the container in a dosed manner, while for putting it into service, the connecting piece can at least be brought from a first position into a second position, the connecting piece comprising an outer tube manufactured from flexible material and an inner tube, the inner tube and the outer tube in the first position each being located at least substantially in the inner space of the container, the outer tube comprising a sliding part which in the first position tightly encloses a top side of the inner tube and a flexible collar which in the first position extends upwards from a top side of the sliding part and is connected, adjacent its top side, to the container, the top side of the inner tube in the first position being slid concentrically into the sliding part of the outer tube, the inner tube being included in the outer tube so as to be telescopically slidable, the sliding part of the outer tube forming a liquid seal with an outer side of the inner tube, and the outer tube in the first position extending at least substantially from the opening into the inner space of the container while the top side of the inner tube extends to a position adjacent the top side of the collar, so that for putting the package into use, the inner tube can be pulled outwards through the opening from an outer side of the container while the inner tube slides telescopically in the sliding part and the collar of the outer tube is also deformed such that said collar is turned inside out when the collar of the outer tube is pulled outside through the opening, the inner side of the collar in the first position forming an outer side of the collar in the second position and an outer side of the collar in the first position forming an inner side of the collar in the second position.

Such package is known per se from GB 901,615 and is used for dispensing concentrates of changeable viscosities that can be dosed in accurate quantities and with changeably settable volumes, in particular for beverage machines. The package is preferably intended for single use and serves for storing and transporting the liquid, as well as for dispensing it in a dosed manner. The dispensing portion is preferably permanently connected to the container and is discarded together with the container. Hence, it concerns a mass article. The container may for instance consist of an exterior casing and an interior, liquid-receiving flexible pouch which shrivels during dispensing.

A drawback of the known device is that in practice, putting the package into use is experienced as being rather awkward. If the tubular connecting piece is pulled outside, it may halfway become clamped with the sliding part, because it is of annular design. Further, there is the risk of the inner tube being pulled from the annular sliding part when it is pulled too hard.

The object of the invention is to meet the above drawbacks and, accordingly, the invention is characterized in that the sliding part is of tubular design, the tubular sliding part tightly enclosing the inner tube in the first and in the second position.

Now, for putting the package into use, only the inner tube should be gripped and pulled outside the package. The sliding part being of tubular design, this operation can be performed in a highly reliable manner and without the above-mentioned drawbacks. This single operation is moreover simple and accurate to perform, due to the telescopic movement of the tubular sliding part. After the inner tube has been pulled outside entirely and the collar has been turned inside out, a firm connection is formed between the tubular connecting piece and the casing. Moreover, the position of the tubular connecting piece and the casing is accurately determined and fixed in advance, permitting the package to be easily inserted into a beverage machine.

The package according to the invention also has the advantage that the manufacturing process of the package can easily be automated. According to a first step, this involves the container being filled via the opening mentioned. Next, the tubular connecting piece can readily be inserted into the container via the opening. Accordingly, the outer side of the tubular connecting piece comes into contact with the liquid in the package. Finally, by means of, for instance, heat sealing, an edge located at the top side of the flexible collar is connected to a circumferential edge of the opening of the container.

In accordance with a preferred embodiment, it applies that an inner wall of the tubular sliding part extends in axial direction of the inner tube along a substantial part of the inner tube in both the first and the second direction. The above-mentioned advantageous properties are thus improved even further.

Preferably, the diameter of the collar in the first position increases in upward direction. The collar may be dimensioned such that when the inner tube is being pulled outside, the inner tube first slides telescopically in the tubular sliding part and that, after that, the outer tube is pulled outside, with the collar folding inside out. However, it is also possible that the collar is dimensioned such that when the inner tube is being pulled outside, the collar is pulled outside first and folds inside out, and that, after that, the inner tube slides telescopically in the tubular sliding part.

In accordance with an advanced embodiment, the inner tube is provided, adjacent its bottom side, with a radially outwardly extending edge. This edge provides that the inner tube cannot be pulled out of the outer tube when the package is put into use. At the same time, this edge serves as a reference indicating when the outer tube has reached its extreme position when said outer tube is being pulled outwards. Hence, in the second position, the edge is located just below the inner wall of the casing.

In particular, the inner tube may further be provided, adjacent its bottom side, with a radially outwardly extending first groove and the tubular sliding part may have its inner side provided with an inwardly extending ridge which, in the second position, extends into the first groove. With this, too, the second position can be accurately predetermined, possibly in combination with the above-mentioned measure.

In particular, it applies that the inner tube is provided, adjacent its top side, with a radially outwardly extending second groove, with the ridge in the first position extending into the second groove. This particular embodiment has as an advantage that the first position is accurately determined as well.

Preferably, the container is composed of a box-shaped casing and a flexible pouch included in the box-shaped casing, the opening extending in the box-shaped casing and the flexible pouch and the collar being connected to the flexible pouch.

When the collar is connected to a flange provided around the opening of the casing and connected to the pouch, it applies that the production process can be performed particularly accurately. In that case, the flange is provided around the opening of the flexible pouch in advance. The circumferential edge of said collar can then be readily connected to the flange, for instance under heating of the flange and said circumferential edge.

Figure 3:
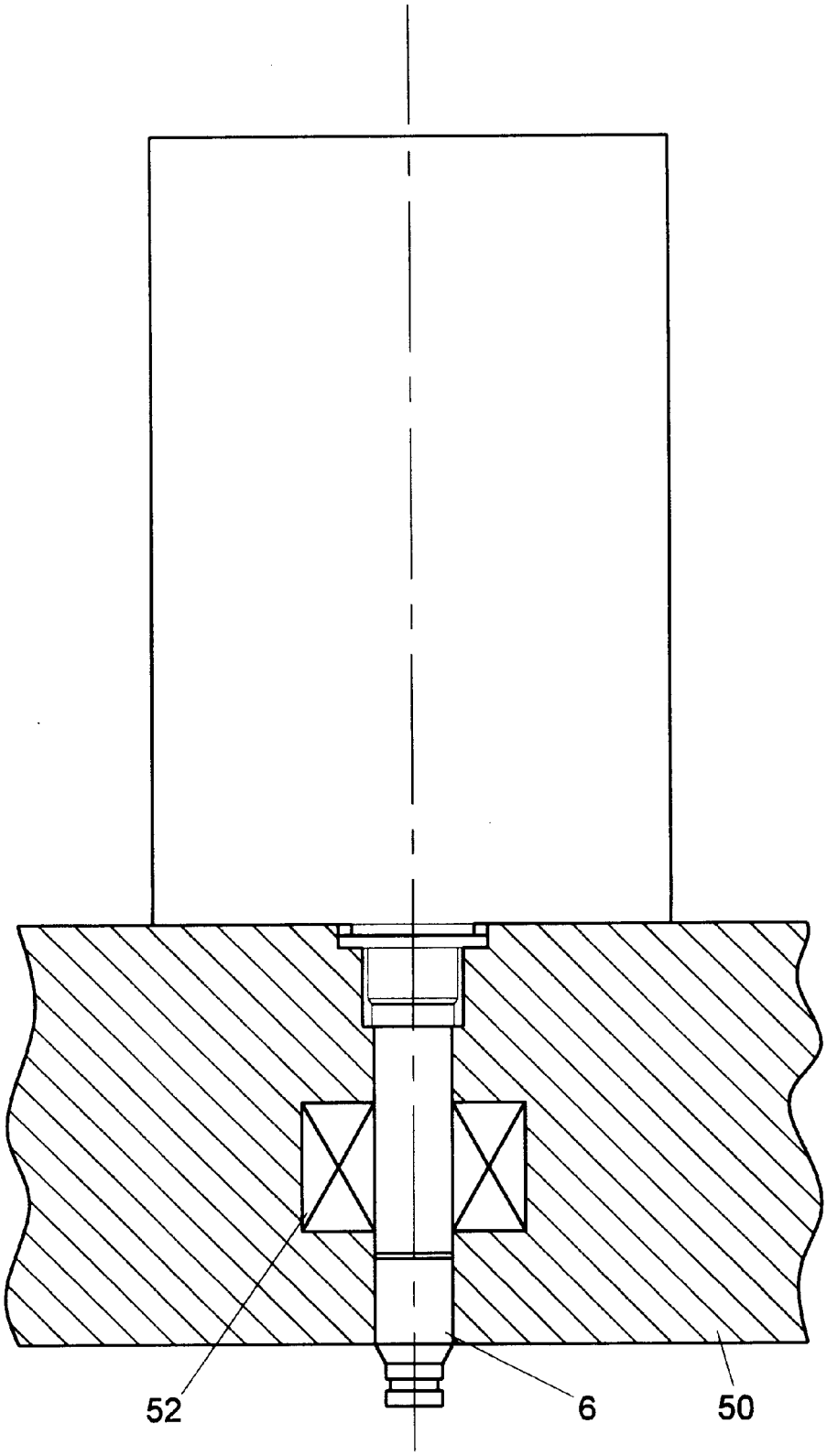
Figures 4A, 4B, 4C:
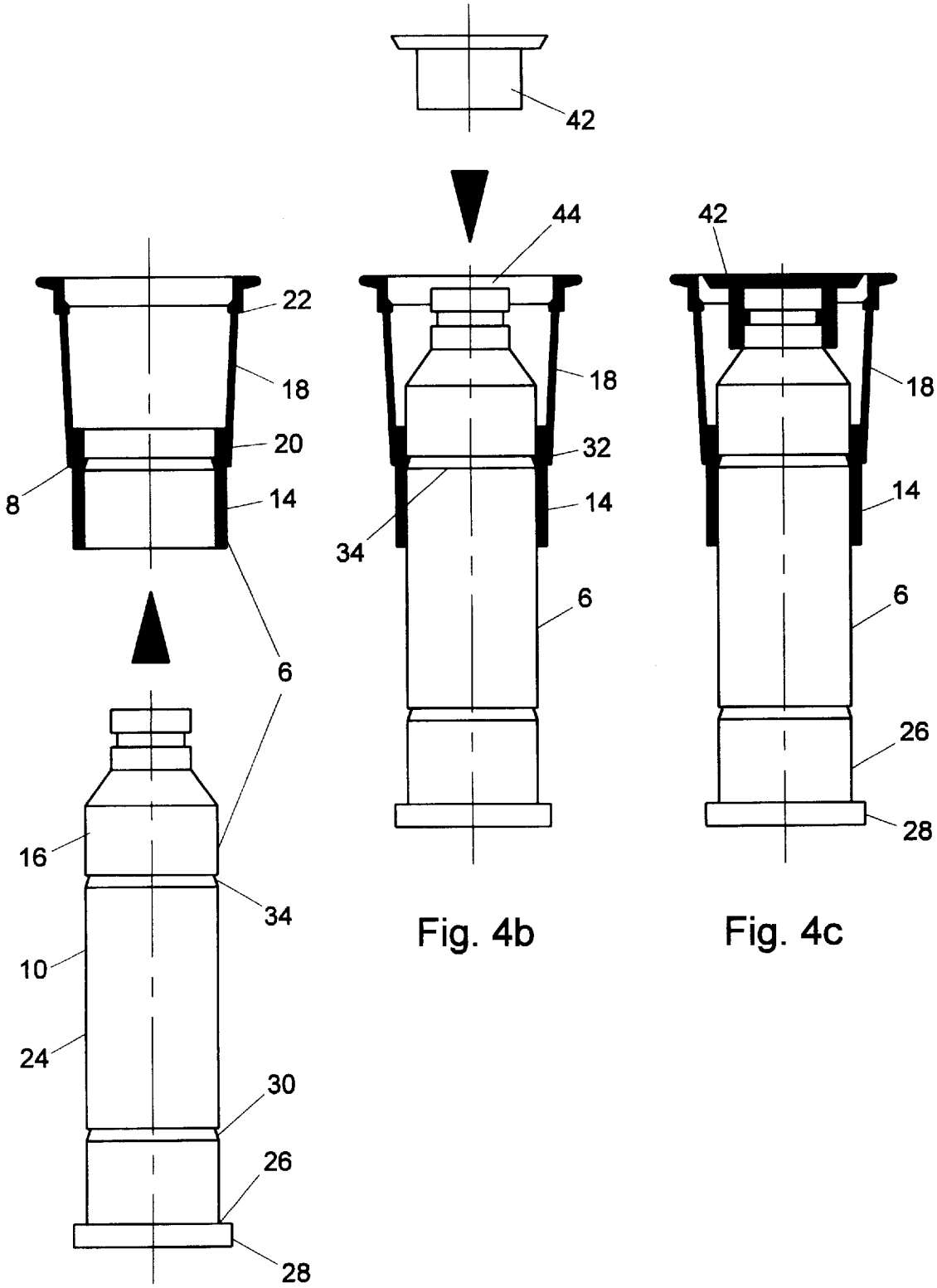
Figures 4D, 4E, 4F, 4G, 4H:
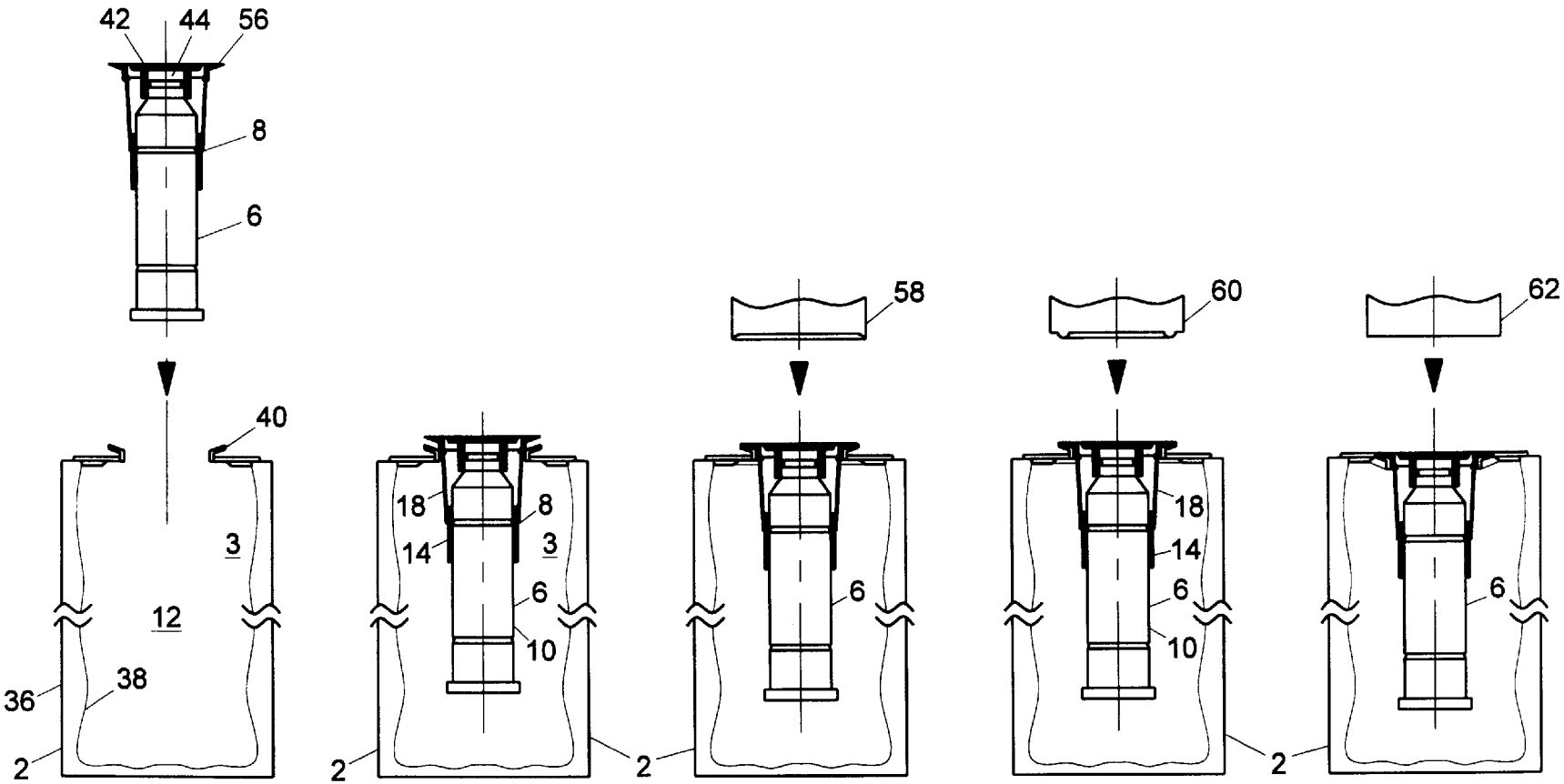
Figure 5C:
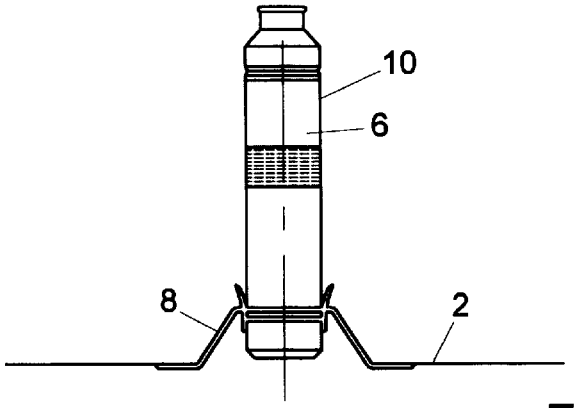
Figure 5B:
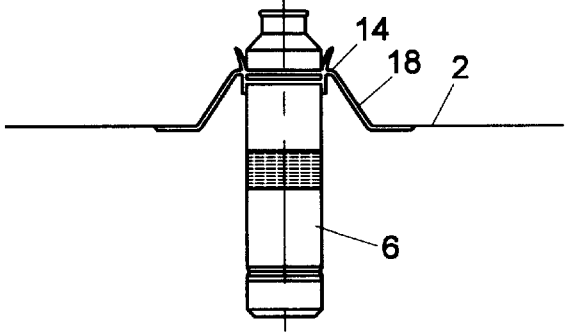
Figure 5A:
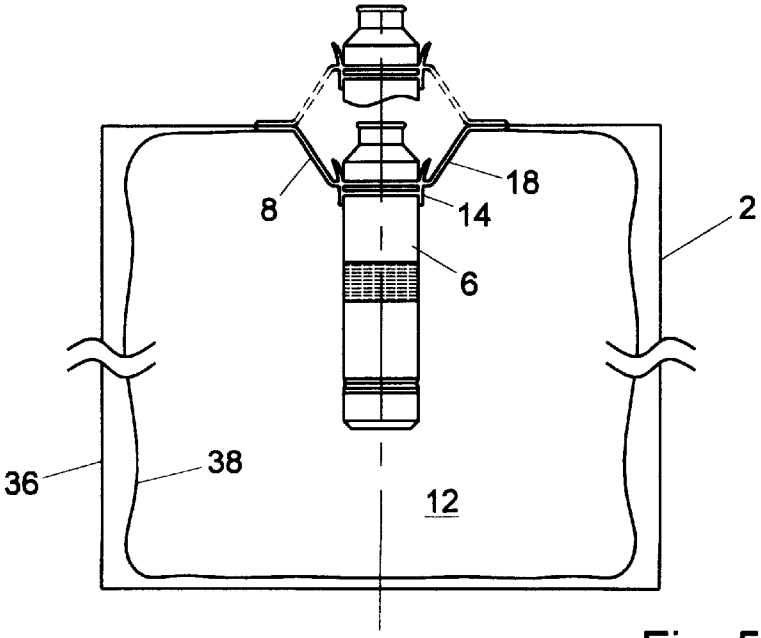

The invention will now be specified with reference to the accompanying drawings. In these drawings:

FIG. 1 is a transparent view of a portion of a three-dimensional representation of a first possible embodiment of a package according to the invention;

FIGS. 2*a*–2*e* respectively show a number of successive stages of a portion of the package according to FIG. 1 when it is put into use;

FIG. 3 shows a cross section of the package according to FIG. 1 when placed in a beverage machine;

FIGS. 4*a*–4*h* respectively show successive stages of the manufacturing process of a package according to the invention; and FIGS. 5*a*–5*c* respectively show a number of successive stages of an alternative embodiment of the package according to the invention when it is put into use.

The package 1 according to the invention as shown in FIG. 1 comprises a container 2 having an opening 4 and a tubular connecting piece 6 connected to the opening. The tubular connecting piece is arranged for dispensing settably variable liquid from the package in a dosed manner. In this example, the package is filled with a viscous liquid 3, such as coffee extract. The tubular connecting piece comprises a dosing device known per se, as for instance described in Dutch patent 184337.

Figure 2E:
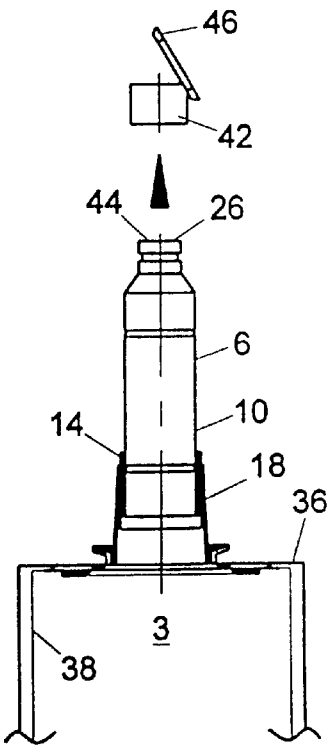
Figure 2D:
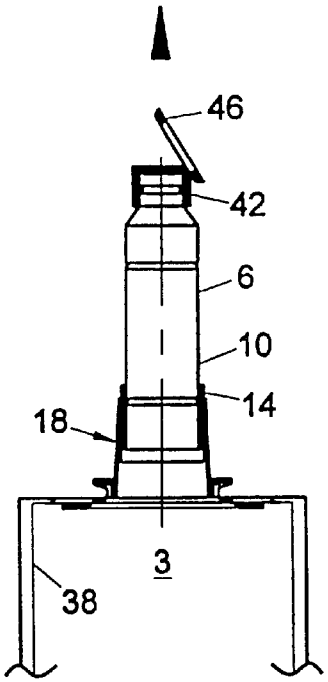
Figure 2C:
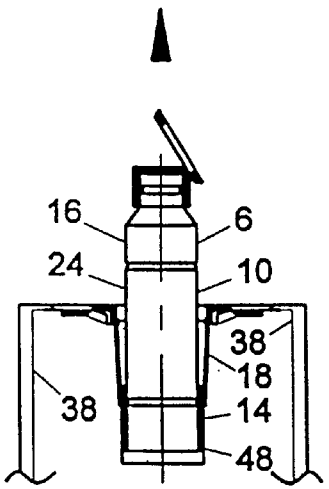
Figure 2B:
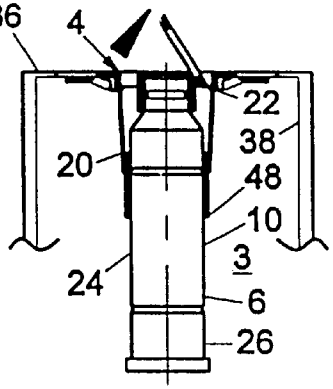
Figure 2A:
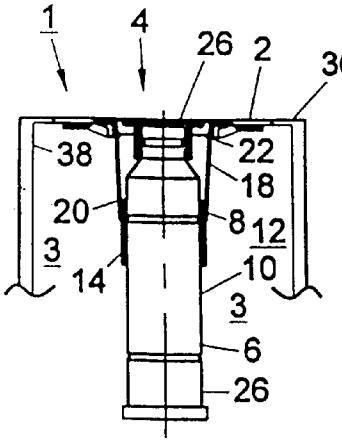

The connecting piece comprises an outer tube 8 manufactured from flexible material and an inner tube 10. As will be explained in more detail hereinbelow, the inner tube 10 is included in the outer tube 8 so as to be telescopically slidable from a second position into a first position. The first position is shown in FIGS. 1, 2*a* and 2*b*, while the second position is shown in FIGS. 2*d* and 2*e*.

In the first position, the inner tube 10 and the outer tube 8 are each located at least substantially, and in this case entirely, in an inner space 12 of the container 2. The outer tube 8 comprises a tubular sliding part 14 which in the first position tightly encloses a top side 16 of the inner tube 10. Further, the outer tube 8 comprises a flexible collar 18 which in the first position extends upwards from a top side 20 of the tubular sliding part. Further, the flexible collar 18 has its top side 22 connected to the casing 2. The top side 16 of the inner tube 8 is concentrically slid into the tubular sliding part of the outer tube 8, with the tubular sliding part 14 of the outer tube 8 forming a liquid seal with the outer side 24 of the inner tube 10. This arrangement is effected in that the outer side 24 of the inner tube 10 is of particularly smooth design, with the tubular sliding part 14 enclosing this outer side tightly. Also the fact that the tubular sliding part 14 in this example is manufactured from an elastic material (for instance elastic rubber) also implies that a proper seal is obtained with the inner tube 10 which in the example is manufactured from hard plastic.

In the first position, the outer tube 8 extends at least substantially from the opening 4 into the inner space 12 of the container 2. In the first position, the top side 16 of the inner tube 10 extends to a position adjacent the top side 22 of the collar 18. As is clearly visible in FIG. 2*a*, the diameter of the collar in the first position increases in upward direction from the tubular sliding part 14.

The inner tube 10 comprises, adjacent its bottom side 26, a radially outwardly extending edge 28. In the first position, the tubular sliding part 14 encloses the inner tube tightly. Further, adjacent its bottom side 26, the inner tube 10 comprises a radially outwardly extending first groove 30. The tubular sliding part 14 has its inner side provided with an outwardly extending ridge 32. In addition, the inner tube 10 is provided, adjacent its top side 20, with a radially outwardly extending second groove 34, the ridge 32 in the first position engaging the second groove 34.

In this example, the container 2 is composed of a boxshaped casing 36 which may for instance be manufactured from cardboard and a flexible pouch 38 included in the box-shaped container. The flexible pouch 38 and the casing 36 are each provided with two coinciding openings constituting in fact the opening 4 of the container 2. Adjacent the opening 4, the flexible pouch 38 is connected to the inner side of the casing 36 by means of, for instance, adhesive.

The collar 18 is connected to a flange 40 which is provided around the opening 4 of the container 2 and connected to the pouch 38. By means of, for instance, heat sealing, the flange 40 is connected to the pouch 38 in advance. The connection between the flange 40 and the collar 18 can for instance be designed as a flexible, liquid-tight snap connection which can also be sealed close by means of heat.

The package further comprises a closing cap 42 detachably connected to the top side 16 of the inner tube 10. The closing cap 42 closes off a free end 44 of the inner tube 10 and is to that end connected to the inner tube 10 by a snap connection known per se. The closing cap 42 further has its top side provided with a lip 46 for manually pulling the connecting piece from the first into the second position.

The operation of the device is as follows. In FIG. 1, the connecting piece 6 is in its first position. This means that the package 1 is still closed off and that it can readily be stored by stacking, together with other packages. As the tubular connecting piece 6 is entirely located within the contours of the container 2, the package 1 in this condition has an entirely rectangular shape. This condition of the package is also shown in FIG. 2*a*.

For putting the package into use, the user grips the lip 46 and moves it upwards, as shown in FIG. 2*b*. Next, the lip 46 is moved upwards from and in a direction away from the casing. This will cause the inner tube 10 to slide upwards telescopically in vertical direction in the outer tube 8. Before this movement is initiated, the ridge 32 will be forced from the first groove 34. This requires some force, which has the advantage that during for instance transport, the inner tube cannot move outwards telescopically in the outer tube of its own accord.

When the inner tube 10 is pulled up further, the ridge 32 will eventually snap into the first groove 30. Also, the edge 28 will abut against the bottom side 48 of the tubular part 8. When the lip 46 is subsequently pulled up further, the collar 18 is deformed such that it is turned inside out when the collar 18 is pulled out through the opening 4. This situation is shown in FIG. 2*d*. Hence, the inner side of the collar 18 in the first position (FIG. 2*a*) is the outer side of the collar in the second position (FIG. 2*d*). Conversely, it applies that an outer side of the collar 18 in the first position (FIG. 2*a*) forms an inner side of the collar 18 in the second position (FIG. 2*d*).

Further, in the second position, it applies that the tubular sliding part 14 lies at least substantially within the collar 18. In other words, in the second position the collar encloses the tubular sliding part at least partially and the two parts are concentrically arranged relative to each other. It also applies that in the second position, the tubular sliding part 14 still tightly encloses the inner tube, as in the first position. This provides extra strength. Further, for the same purpose, it applies that the sliding part 14 is of tubular design, with the tubular sliding part 14 tightly enclosing the inner tube in the first and in the second position. Then, the closing cap 48 can be removed, as shown in FIG. 2*e*. After this, the package can be placed upside down in an automatic beverage dispenser 50 (see FIG. 3) and is ready for use. In this example, the automatic beverage dispenser 50 comprises coils 52 for a wireless operation of a dosing device, known per se, arranged in the inner tube 10 for dispensing liquid from the package in a dosed manner.

In the embodiment described, the collar 18 is dimensioned such that when the inner tube is being pulled outside, the inner tube first slides telescopically in the collar (see FIG. 2*c*) and that, after that, when the inner tube is being pulled out further, the outer tube is pulled out with the collar folding inside out.

However, it is also possible that the collar is dimensioned such that when the inner tube is being pulled out, the collar is folded inside out first. This situation is shown schematically in FIGS. 5*a*–5*c,* in which parts corresponding to those of FIGS. 1–3 have been given identical reference numerals.

FIG. 5*a* demonstrates that the diameter of the collar 18 in vertical direction increases more than the diameter of the collar 18 of FIG. 2. This involves the collar 18 first being folded inside out when it leaves the first position, as shown in FIG. 5*a*. After this, the package is in a condition shown in FIG. 5*b*. When the tubular connecting piece is subsequently pulled up further, the inner tube 10 will be slid telescopically in the tubular sliding part 14. Eventually, the second position will thus be assumed, as shown in FIG. 5*c*.

The manufacture of a package according to FIGS. 1–3 and FIG. 5 can be performed in a simple manner, as is shown in FIGS. 4*a*–4*g*. First, starting from a loose inner tube 10 and a loose outer tube 8 (see FIG. 4*a*), the top side of the inner tube is inserted into the tubular sliding part 14 when the outer tube is in the first position. In this example, the inner tube is inserted into the tubular sliding part 14 from the bottom side of the tubular sliding part. After this, the closing cap 42 can be placed on the free end 44 of the inner tube (FIGS. 4*b*–4*c*). Next, the container 2, composed of the casing 36 and the flexible pouch 38, is filled with the liquid 3 via the opening 4 (FIG. 4*d*). The flange 40 is already provided around the opening 4. After this, the tubular connecting piece 6 is inserted at the casing via the opening 4, as shown in FIGS. 4*d* and 4*e*. A circumferential wall 56, located at the top side 22 of the collar 18 and extending radially outwards, will be tightly positioned within the contours of the flange 40 (FIG. 4*e*). Now, the tubular connecting piece 6 almost completely resides in the liquid 3. Next, by means of a seal element 58, the edge 54 is fused to the flange 40 (FIG. 4*f*). After that, by means of a second seal element 60, which tapers slightly, another heat treatment is performed, for connecting the flange 40 to the edge 54 (FIG. 4*g*). Finally, by means of a pressure element 62, the flange 40, together with the tubular connecting piece, is pressed down further, causing the tubular connecting piece to be located entirely within the contours of the casing (FIG. 4*h*). Now, the package is ready for storage/transport.

The invention is by no means limited to the embodiment outlined hereinabove. For instance, the connecting piece may also be used in packages having a shape deviating from a beam, such as for instance a cylindrical shape, while the package may be of single-walled or multiple-walled design. These variants are each understood to fall within the framework of the invention.

I claim:

1. A package for liquids comprising a container (2) having an opening (4) and a tubular connecting piece (6) connected to the container and arranged for dispensing, via the opening, liquid from an inner space of the container (2) in a connecting piece can at least be brought from a first position into a second position, the connecting piece comprising an outer tube (8) manufactured from flexible material and an inner tube (10), the inner tube and the outer tube in the first position each being located at least substantially in the inner space (12) of the container, the outer tube (8) comprising a sliding part (14) which in the first position tightly encloses a top side (16) of the inner tube and a flexible collar (18) which in the first position extends upwards from a top side (20) of the sliding part and is connected, adjacent its top side (22), to the container, the top side (16) of the inner tube in the first position being slid concentrically into the sliding part of the outer tube, the inner tube being included in the outer tube so as to be telescopically slidable, the sliding part of the outer tube forming a liquid seal with an outer side (24) of the inner tube, and the outer tube in the first position extending at least substantially from the opening from the opening into the inner space of the container while the top side (16) of the inner tube extends to a position adjacent the top side (22) if the collar (18), so that for putting the package into use, the inner tube can be pulled outwards through the opening from an outer side of the container while the inner tube slides telecopically in the sliding part and the collar (18) of the outer tube is also deformed such that said collar is turned inside out when the collar (18) of the outer tube is pulled outside through the opening, the inner side of the collar (18) in the first position forming an outer side of the collar (18) in the second position and an outer side of the collar (18) in the first position forming an inner side of the collar (18) in the second position, wherein the sliding part (14) is of tubular design, the tubular sliding part (14) tightly enclosing the inner tube in the first position and in the second position.

2. A package according to claim 1, wherein an inner wall of the tubular sliding part extends in axial direction of the inner tube along a substantial part of the inner tube in both the first and the second direction.

3. A package according to claim 1 wherein in the second position, the collar encloses the tubular sliding part at least partially.

4. A package according to claim 1 wherein the first position, the diameter of the collar increases in upward direction from the tubular sliding part.

5. A package according to claim 4, wherein the collar is dimensioned such that when the inner tube is being pulled outside, the inner tube first slides telescopically in the tubular sliding part and that, after that, the outer tube is pulled outside, with the collar folding inside out.

6. A package according to claim 1, wherein the collar is dimensioned such that when the inner tube is being pulled outside the collar is pulled outside first and folds inside out, and that, after that, the inner tube slides telescopically in the tubular sliding part.

7. A package according to claim 1, wherein the inner tube is provided, adjacent its bottom side, with a radially outwardly extending edge (28).

8. A package according to claim 7, wherein in the second position, the edge is located just below an inner wall of the casing.

9. A package according to claim 1, wherein the inner tube is provided, adjacent its bottom side with a radially outwardly extending first groove (30) and that the tubular sliding part has its inner side provided with an inwardly extending ridge (32) which, in the second position, extends into the first groove.

10. A package according to claim 9, wherein the inner tube is provided, adjacent its top side with a radially outwardly extending second groove (34), the ridge (32) in the first position extending into the second groove (34).

11. A package according to claim 1, wherein the container is composed of a box-shaped casing (36) and a flexible pouch (38) included in the box-shaped casing, the opening extending through the box shaped casing and the flexible pouch, and the collar being connected to the flexible pouch.

12. A package according to claim 11, wherein the collar is connected to a flange (40) provided around the opening of the container and connected to the pouch.

13. A package according to claim 1, wherein the package further comprises a closing cap (42) which is detachably connected to the top side (24) of the inner tube and closes off a free end (44) of the inner tube.

14. A package according to claim 13, wherein the closing cap has its top side provided with a lip (46) for manually moving the connecting piece (6) from the first position into the second position.

15. A package according to claim 1, wherein the inner tube comprises a wirelessly controllable dosing device for dispensing liquid from the package in a dosed manner.

16. A tubular connecting piece suitable for use in a package according to claim 1.

* * * * *